US005842940A

United States Patent [19]

Macaluso

[11] Patent Number: 5,842,940

[45] Date of Patent: Dec. 1, 1998

[54] MULTI-USE NET

[76] Inventor: Anthony G. Macaluso, 7101 Circa de Media, Escondido, Calif. 92029

[21] Appl. No.: 899,906

[22] Filed: Jul. 24, 1997

[51] Int. Cl.[6] ..... A63B 63/00

[52] U.S. Cl. ..... 473/478; 273/400; 473/197

[58] Field of Search ..... 473/478, 197; 273/400

[56] References Cited

U.S. PATENT DOCUMENTS

| | | | |
|---|---|---|---|
| 5,427,381 | 6/1995 | Macaluso et al. | 273/400 |
| 5,433,433 | 7/1995 | Armell | 473/478 |
| 5,569,094 | 10/1996 | Macaluso | 473/197 |

*Primary Examiner*—William H. Grieb

[57] ABSTRACT

A multi-use net includes a frame formed from a single wire. The frame is arranged to have an upper frame portion and a lower frame portion. The lower frame portion forms a base that supports the upper frame portion in a generally upright orientation on a generally horizontal surface with the base extending in a forward direction relative to the upper frame portion. A fabric section is connected to the frame and arranged for a projectile to be incident thereon. A pair of rear support members is connected to the frame and arranged to extend therefrom in a direction opposite to that of the lower frame portion. A pair of straps extend between the upper and lower frame sections to retain the upper and lower frame sections at a selected orientation with respect to one another.

9 Claims, 3 Drawing Sheets

MULTI-USE NET

BACKGROUND OF THE INVENTION

This invention relates generally to apparatus and methods that allow a person to practice hitting or throwing a ball or the like in a confined space without having the ball travel a large distance or hit other persons or objects and cause injury or damage.

SUMMARY OF THE INVENTION

The multi-use net according to the invention has several advantages over the prior art. The multi-use net preferably includes a frame that preferably comprises a single wire. The multi-use net according to the present invention is easy to manufacture, requires no assembly, is sturdy, self-standing, easily collapsible for storage or transit and can be used indoors or outdoors.

A multi-use net structure according to the present invention comprises an elastic frame member arranged to have an upper frame portion and a lower frame portion. The lower frame portion forms a base that supports the upper frame portion in a generally upright orientation on a generally horizontal surface when the multi-use net is in its erected configuration with the base extending in a forward direction relative to the upper frame portion. A fabric section is connected to the frame and arranged for a projectile to be incident thereon. A pair of rear support members is connected to the frame and arranged to extend therefrom in a direction opposite to that of the lower frame portion. A pair of straps extend between the upper and lower frame sections to retain the upper and lower frame sections at a selected orientation with respect to one another.

A band preferably extends between opposite sides of the frame to cooperate with the pair of straps to retain the upper and lower frame sections at the selected orientation with respect to one another. The multi-use net according to the present invention further comprises a pair of weighted bags connected to the rear support members. Each of the rear support members preferably further comprises a rod connected to the frame and a fabric connected to the rod and to the frame and arranged to provide support to the frame.

The rod preferably is connected to the frame by a mounting bracket. The mounting bracket may be removable from the frame when the net is to be folded. Alternatively, the mounting bracket may be rotatably mounted to the frame.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
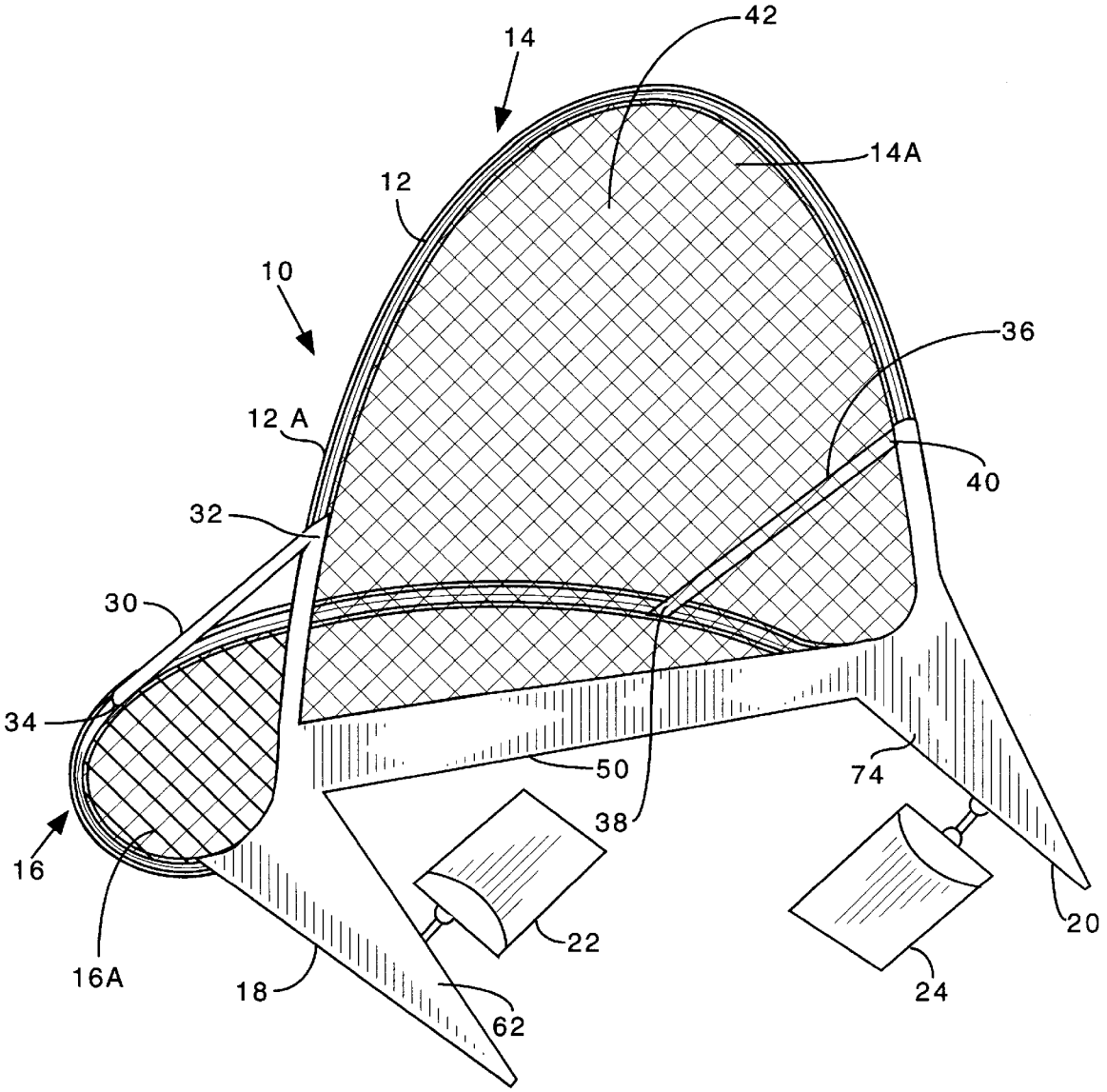
FIG. 1 is a perspective view showing a frame and net structure that may be included in the present invention.
Figure 2:
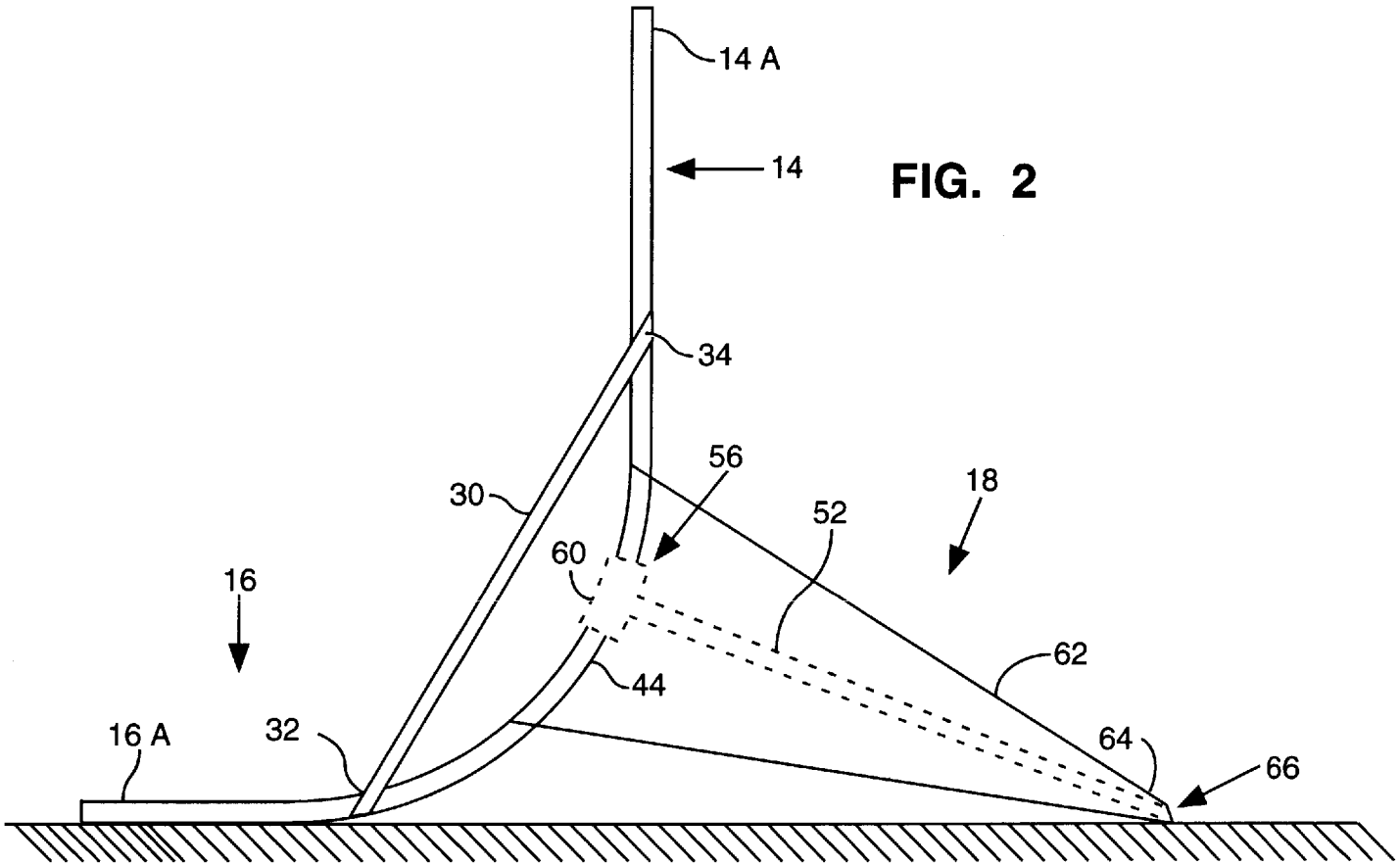
FIG. 2 is a side elevation view of the net of FIG. 1.
Figure 3:
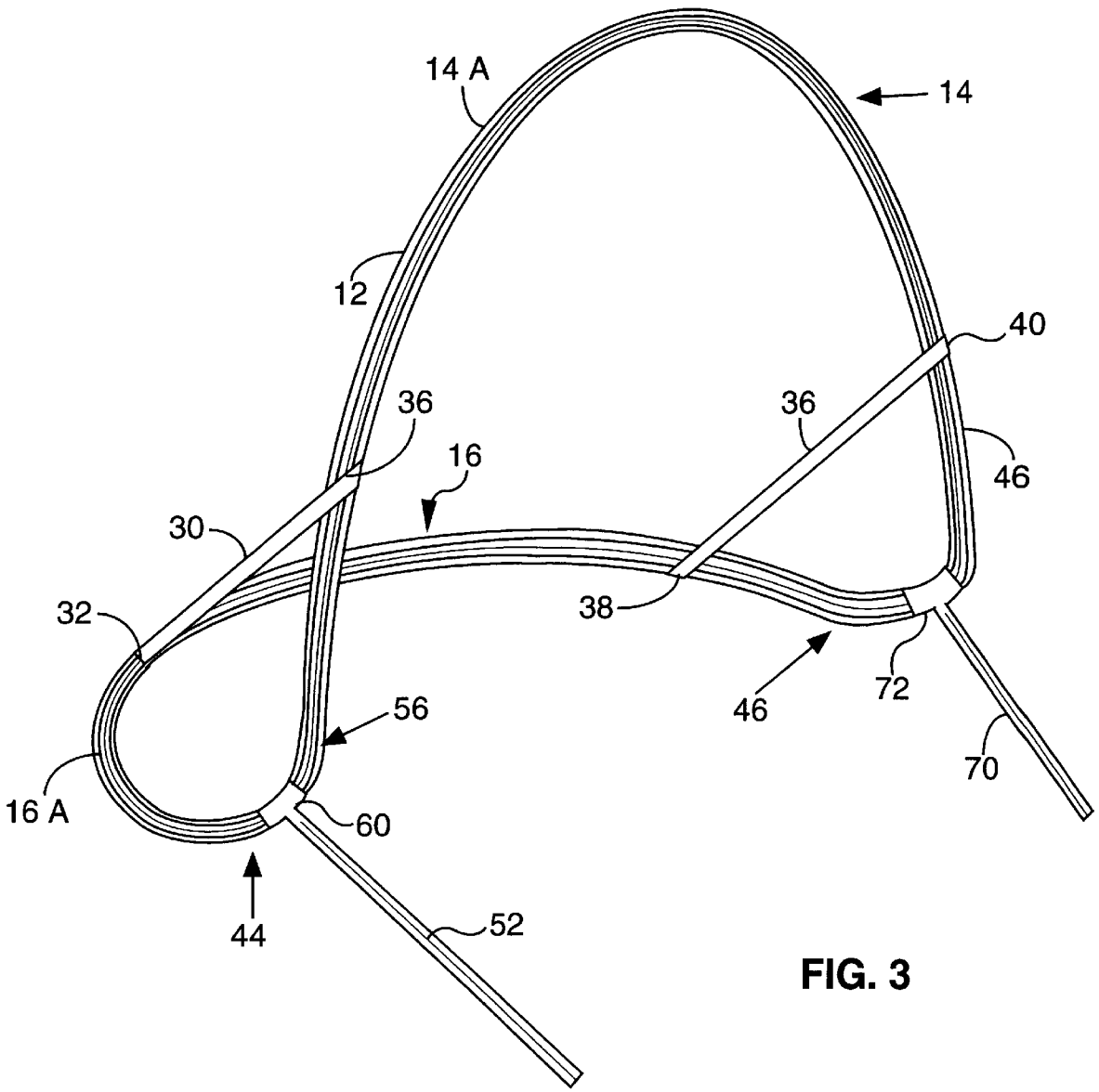
FIG. 3 is a perspective view illustrating a frame and support structure that may be included in the net apparatus of FIGS. 1 and 2.

Referring to FIGS. 1—3, a multi-use net 10 comprises a frame 12 that includes a wire frame member 12 that preferably is formed as a continuous loop. The wire frame member 12 is formed into an upper portion 14 and a base portion 16. A pair of rear supports 18 and 20 extend from the wire frame 12 and cooperate with the base portion 16 to hold the net 10 in an upright position when the net 10 is in use. A pair of weights 22 and 24 may be attached to the rear supports 18 and 20, respectively, to aid in stabilizing the multi-use net 10.

The wire frame 12 preferably is formed of steel spring wire. The ends of the wire frame member 12 preferably are connected together by any convenient means so that the frame member 12 is a continuous loop. The wire frame member 12 preferably is placed inside a sleeve 12A or the like.

A first strap 30 extends between a first location 32 on one side of the front portion of the base 16 and a location 34 on the upright portion. The strap 30 is preferably connected to the sleeve 12A at the locations 32 and 34. The upper end of the strap 32 preferably is attached to the sleeve a distance of three to five feet above the lowest portion of the base 16. A second strap 36 extends between a location 38 on the base portion 16 opposite from the location 32 to a location 40 on the upright portion 14. The straps 30 and 36 preferably are formed of a suitable fabric or other similar material. The straps 30 and 36 and the sleeve 12A cooperate to hold the wire frame in the desired shape to form the base 16 and upright portion 14. As shown in FIGS. 1 and 3, the upright portion 14 and the base 16 and preferably have generally planar end portions 14A and 16A, respectively.

A fabric section 42 is connected to the sleeve 12A so that the entire region bounded by the wire frame 12 and sleeve 12A is covered by the fabric section 42. The fabric section preferably is formed of netting or the like and is arranged to absorb the impact of a projectile such as a golf ball, tennis ball, baseball, football or the like. The fabric section 42 absorbs the impact so that the projectile has no appreciable recoil velocity after it hits the fabric section 42. Instead of using the sleeve 12A, the net 42 may be attached to the wire frame 12 by means of straps or other convenient means..

The wire frame 12 has curved regions 44 and 46 that form a transition from the base 16 to the upright portion 14. The angle between the base 16 and upright portion 14 may be any suitable angle for reflecting the projectile back generally in the direction from which it was traveling before striking the net 42.

A band 50 extends between the curved regions 44 and 46. The band 50 preferably is a few inches wide and serves to help retain the wire frame 12 in the desired configuration shown in FIG. 1. The band 50 preferably is formed of a suitable fabric.

The rear support member 18 includes a rod 52 that is mounted to the wire frame 12 at a location 56 that may be generally in the curved region 44. The rod 52 may be attached to the wire frame 12 by any convenient means such as a bracket 60 that encloses the wire frame 12. When the frame is erected, the rod 52 extends away from the wire frame 12. The rod 52 preferably is attached to a fabric section 62 that may be generally triangular in shape. The apex 64 of the triangular fabric section is formed by engaging the outer end 66 of the rod 52 with the fabric. The edges of the fabric section 62 are attached to the sleeve 12A by any convenient means such as stitching or hook and loop fasteners.

The rear support 20 includes a rod 70 that is connected to the frame 12 by a bracket 72. The rear support 20 includes a fabric section 74 that is essentially identical to the fabric section 62 of the first rear support member 18 and that is attached to the frame 12 in the same way as the fabric section 62.

The brackets 60 and 72 may be removable from the frame 12 when the net apparatus is to be folded for storage. The brackets 60 and 72 may alternatively be rotatable on the frame 12 when the net apparatus is to be stored. The support members 18 and 20 thus may be rotated toward the band 50 so that the wire frame 12 may be coiled when the net apparatus 10 is to be stored or transported.

Because of the memory of the frame 12 for the erected configuration, unless it is constrained, the spring forces in the frame members 12 will cause the multi-purpose net 10 to spontaneously assume the erected configuration. Therefore, the multi-purpose net 10 is self-erecting if the frame 12 is not constrained to some other configuration.

The first step in folding the multi-use net 10 for storage is to pull the extreme edges of the upright portion 14 and the base 16 toward one another so that they are substantially adjacent so that the frame 12 is shaped generally as a "taco shell." The folding process continues by twisting the frame 12 to form a pair of loop, which may be then held close together and secured by a strap or the like. The multi-purpose net 10 is thus coiled up in a compact configuration suitable for storage or transport. The method of folding the multi-use net 10 is essentially disclosed in U.S. Pat. No. 5,569,094, which issued Oct. 29, 1996 to the present inventor, Anthony G. Macaluso. The disclosure of U.S. Pat. No. 5,569,094 is hereby incorporated by reference into this disclosure.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention. The foregoing detailed description is to be clearly understood as given by way of illustration and example only, the spirit and scope of this invention being limited solely by the appended claims.

What is claimed is:

1. A multi-use net structure, comprising:

an elastic frame member arranged to have an upper frame portion and a lower frame portion, the lower frame portion forming a base that supports the upper frame portion in a generally upright orientation on a generally horizontal surface when the multi-use net is in its erected configuration, the base extending in a forward direction relative to the upper frame portion;

a fabric section connected to the frame and arranged for a projectile to be incident thereon;

a pair of rear support members connected to the frame and extending therefrom in a direction opposite to that of the lower frame portion; and a pair of straps extending between the upper and lower frame sections to retain the upper and lower frame sections at a selected angle with respect to one another.

2. The multi-use net of claim 1 wherein the frame has a pair of curved transition portions between the base and the upper frame portion.

3. The multi-use net of claim 2, further comprising a band extending between the pair of curved transition portions to cooperate with the pair of straps to retain the upper and lower frame sections at a selected orientation with respect to one another.

4. The multi-use net of claim 1, further comprising a first weighted bag connected to a first one of the rear support members and a second weighted bag connected to the other rear support member.

5. The multi-use net of claim 1, wherein each of the rear support members further comprises:

a rod connected to the frame; and a fabric connected to the rod and to the frame and arranged to provide support to the frame.

6. The multi-use net of claim 5, further comprising a mounting bracket connected between the rod and the frame.

7. The multi-use net of claim 6 wherein the mounting bracket is removable from the frame.

8. The multi-use net of claim 6 wherein the mounting bracket is rotatably mounted to the frame.

9. A foldable net structure for erection on a generally horizontal surface and use in an activity involving a projectile, comprising, an elastic frame member arranged to have an upper frame portion and a lower frame portion, said lower frame portion forming a base that helps support said upper frame portion in a generally vertical orientation when the net structure is in its erected configuration;

a sleeve connected to said frame member substantially completely around the periphery of said frame member;

a net connected to said sleeve and arranged to span the interior area bounded by the frame member and absorb the impact of a projectile directed into said interior area; a pair of rods connected to said sleeve and extending to said generally horizontal surface and arranged to cooperate with said base to hold said upper frame portion in its generally vertical orientation; and a fabric band connected to said sleeve between said upper and lower frame portions and arranged to cooperate with said base and said pair of rods to hold said upper frame portion in its generally vertical orientation.

* * * * *